United States Patent [19]

Jones

[11] 3,938,701

[45] Feb. 17, 1976

[54] TOOTHPICK DISPENSER

[76] Inventor: Francis J. Jones, 11035 W. 26th Ave., Lakewood, Colo. 80215

[22] Filed: Mar. 26, 1974

[21] Appl. No.: 454,813

Related U.S. Application Data

[63] Continuation of Ser. No. 299,845, Oct. 24, 1972, abandoned.

[52] U.S. Cl. ..... 221/184; 221/202; 221/256; 221/271

[51] Int. Cl.[2] ..... B65G 59/06

[58] Field of Search ..... 221/175, 183, 184, 186, 221/193, 196, 200, 202, 256, 257, 266, 268, 271

[56] References Cited

UNITED STATES PATENTS

| | | | |
|---|---|---|---|
| 924,407 | 6/1909 | Whitcomb | 221/271 X |
| 1,880,163 | 9/1932 | Villochi | 221/184 |
| 2,187,218 | 1/1940 | Witt | 221/256 X |
| 3,539,073 | 11/1970 | Edwards | 221/196 |

*Primary Examiner*—Robert B. Reeves
*Assistant Examiner*—David A. Scherbel
*Attorney, Agent, or Firm*—Reilly and Hancock

[57] ABSTRACT

An apparatus for dispensing toothpicks or the like comprises a receptacle having a lower surface that slopes downwardly from the rear wall of the receptacle toward the front wall and is spaced slightly from the front wall to define a discharge opening through which toothpicks may pass one at a time. A slide member is reciprocally mounted beneath the inclined lower surface and held in place by a bottom plate which is secured to the receptacle by fastening screws that pass through guide slots in the slide member to guide movement of the slide. The slide member is spring biased forwardly and includes a delivery channel that is alternately positionable between a receiving position in alignment with the discharge opening and a removal position forwardly of the front wall of the receptacle. The slide member also includes upwardly projecting alignment fingers that are adapted to move through alignment slots in the inclined surface of the receptacle to align the toothpicks with the discharge opening and thereby assure reliable deposition of the toothpicks in the delivery channel.

6 Claims, 8 Drawing Figures

TOOTHPICK DISPENSER

This is a continuation of application Ser. No. 299,845, filed Oct. 24, 1972 now abandoned.

The present invention generally concerns dispensing apparatus and more particularly apparatus for dispensing toothpicks or similarly shaped articles in a reliable and efficient manner.

Dispensing apparatus for toothpicks, matches, cigarettes and the like have served a useful purpose for many years where it is desired to maintain a supply of the articles in a manner such that they can be delivered one at a time when desired. Early dispensing apparatus of this type, such as disclosed in U.S. Pat. No. 1,173,069, issued to H. C. Walker and U.S. Pat. No. 1,183,279, issued to F. O. Degenhardt were not entirely satisfactory since adequate means were not provided for assuring that two articles did not become wedged at the discharge opening from the receptacle and consequently the apparatus of this type were prone to becoming jammed and were not totally reliable. Various devices have been contrived for preventing articles from becoming jammed in similar dispensing apparatus as evidenced by U.S. Pat. No. 924,407, issued to S. Whitcomb and U.S. Pat. No. 1,678,355, issued to C. C. Roberts.

The dispensing apparatus of the present invention was devised to provide a simple yet reliable apparatus for dispensing toothpicks or other like articles so that the articles are delivered one at a time and are prevented from becoming jammed or dislodged at the discharge opening from the receptacle in which the articles are retained. More particularly, the dispensing apparatus includes a receptacle in which the articles are stored, the receptacle having an inclined lower surface for urging articles therein toward a discharge opening in a forward portion of the receptacle. A slide member has a delivery channel near its forwardmost edge and is slidably received in the receptacle beneath the inclined surface so that the delivery channel is movable between a removal position exteriorly of the receptacle and a receiving position in vertical alignment with the discharge opening. Alignment fingers protruding upwardly from the slide member within the receptacle reciprocate through slots in the inclined lower surface of the receptacle so as to urge articles in the receptacle adjacent the discharge opening into a single-file stack that is in vertical alignment with the discharge opening. In this manner, the articles are properly aligned and disposed for deposition one at a time into the delivery channel whereby the articles do not become wedged or dislodged and one article is reliably deposited in the delivery channel each time the delivery channel is moved into its receiving position. Another feature of the invention is that the slide member is slidably retained in the receptacle by a bottom plate which is anchored to the receptacle with fastening screws that pass through guide slots in the slide member so that the slide member is guided in its reciprocating movement.

Accordingly, it is an object of the present invention to provide a dispensing apparatus for toothpicks or other like articles wherein the articles are prevented from becoming jammed in the apparatus and are reliably dispensed one at a time.

It is another object of the present invention to provide a dispensing apparatus for toothpicks or other like articles, the apparatus having an inclined lower surface to urge the articles toward a discharge opening in the receptacle and alignment means for maintaining the article adjacent the discharge opening in a single-file stack vertically aligned with the discharge opening so that the articles are reliably dispensed one at a time.

It is another object of the present invention to provide a relatively simple and inexpensive apparatus for dispensing toothpicks or other like articles in a reliable manner and including means for preventing the articles from becoming jammed adjacent a discharge opening from the apparatus.

It is another object of the present invention to provide a dispensing apparatus for toothpicks or other like articles wherein a slide member is slidably disposed beneath a discharge opening in a receptacle for the toothpicks so as to carry one toothpick at a time from a location within the receptacle to a location exteriorly of the receptacle, the apparatus including means for guiding the sliding movement of the slide member.

Other objects, advantages and capabilities of the present invention will become more apparent as the description proceeds taken in conjunction with the accompanying drawings, in which.

Figure 1:
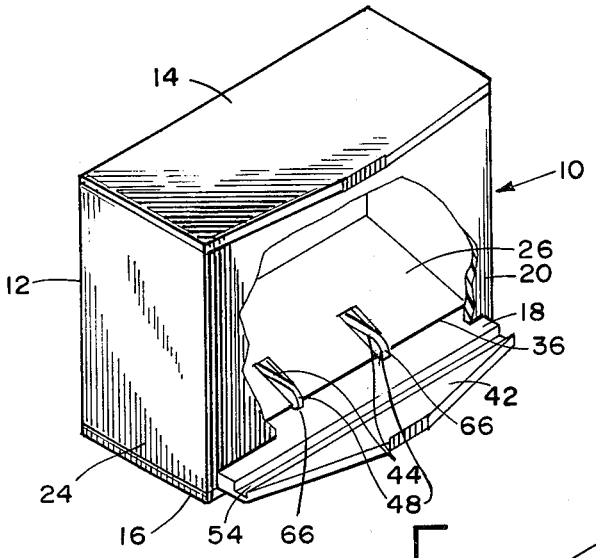
FIG. 1 is a perspective view of the dispensing apparatus of the present invention with a portion cut away to better illustrate the apparatus.
Figure 2:
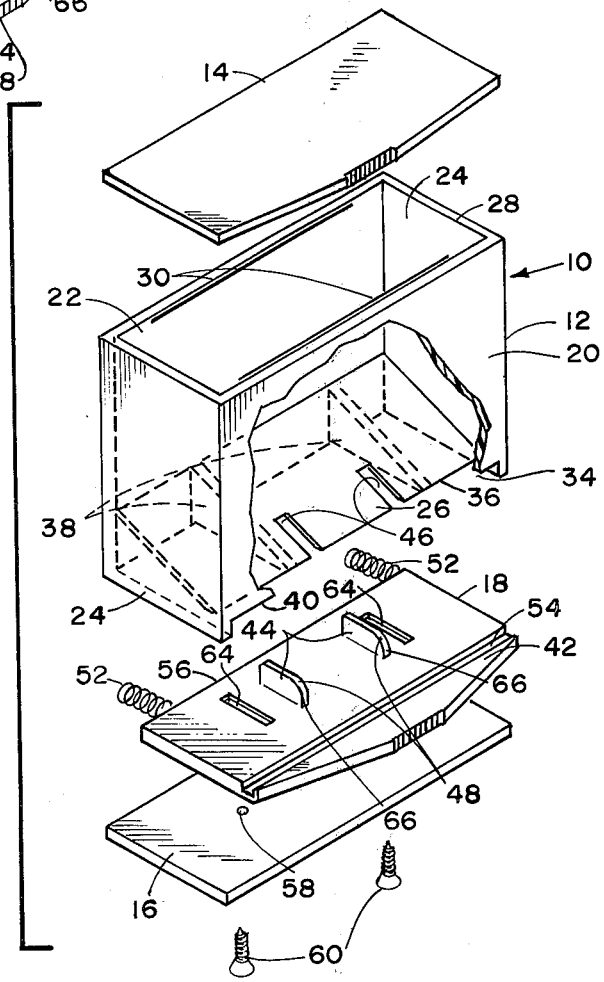
FIG. 2 is an exploded perspective view of the apparatus of FIG. 1 looking downwardly on the apparatus.
Figure 3:
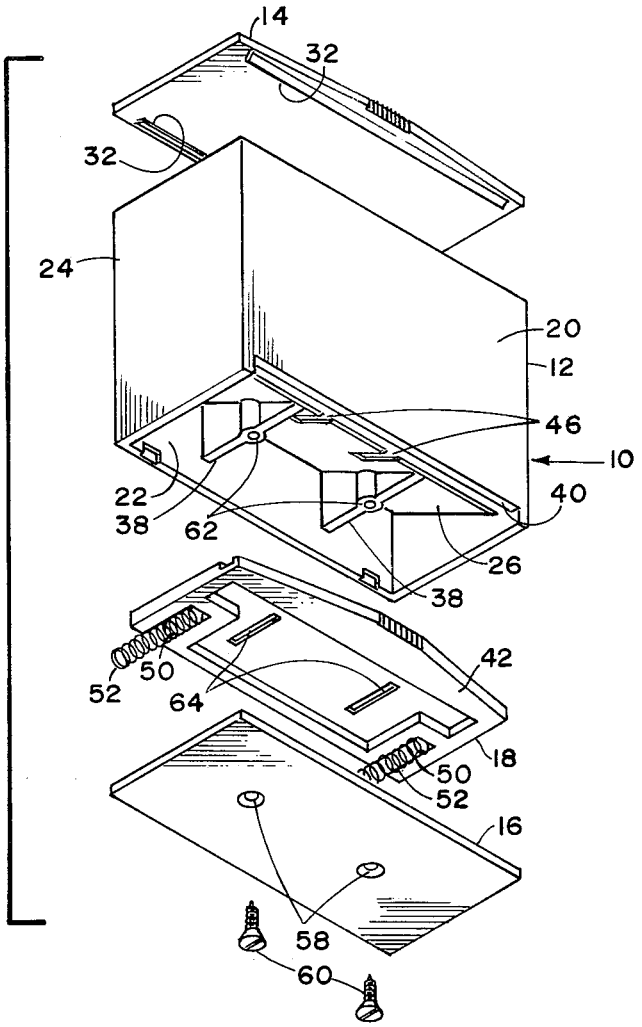
FIG. 3 is an exploded perspective view of the dispensing apparatus of FIG. 1 looking upwardly at the apparatus.

Referring first to FIGS. 1, 2, and 3, the dispensing apparatus 10 of the present invention is seen to include a box or receptacle 12 in which toothpicks T or other like articles to be dispensed are retained, a top 14 for the receptacle 12, a bottom plate 16 for the receptacle, and a delivery slide or slide member 18 slidably received between the bottom plate 16 and the receptacle for carrying toothpicks one at a time from the interior of the receptacle to the exterior.

The receptacle 12 is best seen in FIG. 2 to have a front wall 20, a rear wall 22, end walls 24, an inclined lower surface 26 and an open top 28. Inwardly projecting elongated beads 30 along the upper edge of the front and rear walls 20 and 22 respectively of the receptacle mate with grooved downwardly protruding flanges 32 on the corresponding edges of the undersurface of the top 14 so that the top can be conventionally snapped onto or removed from the receptacle 12.

The inclined lower surface 26 is either bonded or integrally molded to the rear and end walls 22 and 24 respectively of the receptacle 12 so as to leave a longitudinal space or discharge opening 34 between the forward edge 36 of the inclined surface 26 and the front wall 20 of the receptacle which extends substantially the entire length of the receptacle. Triangular shaped gussets 38 are bonded or integrally molded to the underside of the inclined surface 26 and to the rear wall 22 of the receptacle to give supporting strength to the inclined surface.

The lower end of the front wall 20 of the receptacle is recessed defining a slide opening 40 to receive the slide member 18 whereby the slide member is selectively movable through the opening 40 in a manner to be described hereinafter. The slide member 18 is substantially rectangular in shape, is slightly shorter than the receptacle, and has a forward finger tab portion 42 which is reduced in thickness facilitating hand manipulation of the slide. A pair of longitudinally spaced transversely extending alignment fingers 44 project upwardly from the upper surface of the slide member 18 and are aligned with alignment slots 46 in the inclined surface 26 so as to be reciprocably movable therethrough. The forward corner 48 of each of the fingers 44 is rounded for a purpose to be explained later.

The underside of the slide member 18, as best seen in FIG. 3, has recessed areas defining sockets 50 to retain a pair of biasing coil springs 52 which extend rearwardly from the slide 18 and are received in notches 54 in the lower edge of the rear wall 22 of the receptacle. The springs 52 bias the slide member forwardly so that it normally projects a slight distance away from the front wall 20 of the receptacle with the finger tab portion 42 fully exposed as shown in FIG. 1. A delivery channel 54 in the upper surface of the slide member extends the full length of the slide member adjacent the rear edge of the finger tab 42 and is open at both ends. The delivery channel 54 is movable with the slide member between a receiving position, FIG. 4B, wherein it is vertically aligned with the discharge opening 34 and a removal position, FIGS. 4A and 4C, in front of the front wall 20 whereby it is adapted to carry one toothpick T at a time from the interior to the exterior of the receptacle 12.

Figure 4A:
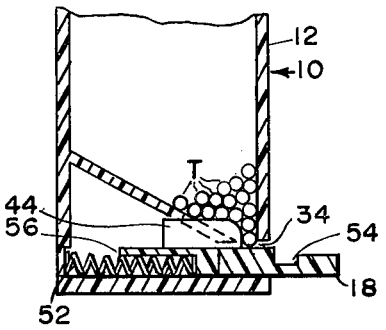
FIGS. 4A, 4B and 4C are fragmentary transverse sectional views illustrating the operation of the dispensing apparatus of FIG. 1.
Figure 4B:
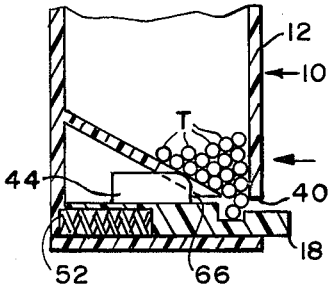
Figure 4C:
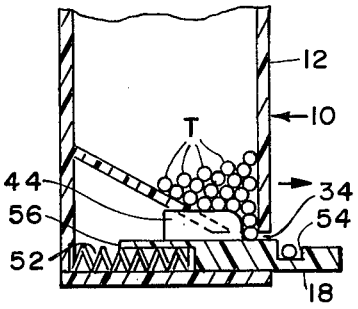

It can be seen in FIGS 4A through 4C that when the delivery channel 54 is in its removal position, the rearward edge 56 of the slide member 18 is spaced from the rear wall 22 of the receptacle 12. Accordingly, the slide member can be moved rearwardly, compressing the springs 52, to a point at which the delivery channel 54 moves into its receiving position in vertical alignment with the discharge opening 34. In the receiving position, a toothpick T, or whatever other article is in the receptacle, will drop by gravity into the delivery channel 54 so that when the rearward pressure on the slide member is released, the slide member will automatically move forwardly returning the delivery channel to its removal position thereby carrying the toothpick to the exterior of the receptacle.

The slide member 18 is slidably maintained in the receptacle 12 by the bottom plate 16 which is provided with spaced openings 58 through which fastening screws 60 are passed to secure the bottom plate 16 to the receptacle 12. The gussets 38, beneath the inclined surface 26, have internally threaded vertical holes 62 aligned with the openings 58 in the bottom plate so that the fastening screws 60 can be screwed into the holes 62 to tighten the bottom plate against the lower edges of the rear and end walls 22 and 24 respectively of the receptacle. The slide member 18 is then free to slide in the space between the bottom of the gussets 38 and the upper surface of the bottom plate. The screws 60 pass through guide slots 64 in the slide member 18 and thereby serve to guide the sliding movement of the slide member whereby it does not become ascew with the receptacle and possibly thereby become wedged and immovable.

As will be appreciated by reference to FIGS. 4A through 4C, the alignment fingers 44 serve to align toothpicks T which are near the discharge opening 34 of the receptacle 12 so that they extend longitudinally of the receptacle and are parallel to and in vertical alignment with the delivery opening 34. When so aligned, a single toothpick is always properly positioned for deposition into the delivery channel 54 when the delivery channel is moved beneath the discharge opening into its receiving position.

Figure 5A:
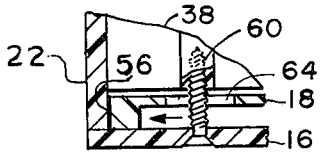
FIGS. 5A and 5B are fragmentary transverse sectional views illustrating the limitations on the forward and rearward sliding movement of the slide member for the apparatus of FIG. 1.
Figure 5B:
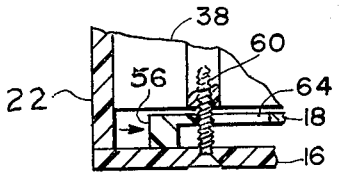

As shown in FIG. 4A, when the delivery slide 18 is in its normal forward position, with the delivery channel 54 located forwardly of the front wall 20 in its removal position, the alignment fingers 44 protrude through the alignment slots 46 in the inclined lower surface 26 of the receptacle with the forward edges 66 of the alignment fingers in spaced relationship from the front wall 20. The space between the forward edges 66 of alignment fingers and the front wall in this position is slightly greater than the width of a toothpick T so that a single-file substantially vertical stack of the toothpicks will be formed in the space between the alignment fingers and the front wall. Since there are two of the alignment fingers and they are spaced longitudinally of the receptacle, the toothpicks adjacent the discharge opening 34 will be shoved into a position parallel with the front wall 20 of the receptacle and in vertical alignment with the discharge opening. Thereafter, when the slide member 18 is moved rearwardly in the receptacle so that the delivery channel 54 is disposed beneath the delivery opening 34, the guide fingers 44 automatically retract behind the inclined lower surface 26 leaving the toothpicks properly aligned with the discharge opening so that the lowermost one of the toothpicks will drop by gravity into the delivery channel. It is important to note that the curved forward upper corners 48 of the alignment fingers allow toothpicks, which are not at the bottom of the receptacle, to roll over the fingers and thereby not inhibit or block the forward movement of the fingers. When the slide member is released so that the bias springs 52 cause the slide to move forwardly, the upper surface of the slide member, immediately behind the delivery channel 54, moves beneath the remaining toothpicks in the receptacle and supports the remaining toothpicks while the toothpick which was deposited in the delivery channel is carried forwardly to the removal position of the delivery channel exteriorly of the receptacle. With reference to FIGS. 5A and 5B, it will be appreciated that rearward movement of the slide member 18 is limited by abutment of the rearward edge 56 against the rear wall 22 and forward movement of the slide member is limited by abutment of the fastener screws 60 against the rear end of the guide slots 64 in the slide.

It will, therefore, be appreciated that the dispensing apparatus 10 of the present invention is very simply constructed and yet provides an efficient system for assuring that a single toothpick is deposited into the delivery channel 54 each time the delivery channel is moved into its receiving position. While the dispensing apparatus has been described in connection with dispensing toothpicks, it will be readily apparent that a dispenser operating on the same principle with possibly different dimensions would be equally useful in dispensing other like articles such as matches, cigarettes or the like.

Although the present invention has been described with a certain degree of particularity, it is understood that the present disclosure has been made by way of example and that changes in detail of structure may be made without departing from the spirit thereof.

What is claimed is:

1. A dispensing apparatus for toothpicks or the like comprising, a receptacle in which a plurality of the toothpicks can be stored in stacked substantially parallel relationship, said receptacle having an inclined lower surface on which the toothpicks are supported with at least one slot through the inclined surface along a lowermost edge thereof, a discharge opening adjacent the lowermost edge of the inclined surface through which toothpicks can pass one at a time, a slide member slidably received in a lower portion of the receptacle beneath the inclined surface, elongated delivery channel means in the slide member adapted to retain a single toothpick and movable with the slide member between a receiving position beneath the discharge opening and a removal position exteriorly of the receptacle whereby a toothpick in the delivery channel can be carried from the receptacle to a position exteriorly of the receptacle, and alignment finger means affixed to and protruding upwardly from said slide member through each slot in the inclined surface and being slidable through the slot in a direction parallel to the direction of sliding movement of the slide member to align toothpicks in a single-file stack with the discharge opening whereby to cause the toothpicks to pass one at a time through the discharge opening when the delivery channel is moved beneath the discharge opening and said slide member being retained in the lower portion of the receptacle by a bottom plate, and further including guide slots in said slide member and means on the bottom plate communicating with the guide slots to guide movement of the slide plate so that it does not become misaligned within the receptacle.

2. The dispensing apparatus of claim 1 wherein there are two alignment fingers which move between a location under the inclined surface when the delivery channel is in its receiving position to a location adjacent the discharge opening when the slide member is in its removal position.

3. A dispensing apparatus for toothpicks or other like articles comprising in combination a receptacle having front and rear walls, an inclined supporting surface near the bottom of the receptacle, said inclined surface sloping downwardly from the rear wall toward the front wall and being spaced from the front wall a distance slightly greater than the thickness of the articles to be dispensed, said space between the inclined surface and the front wall defining a discharge opening through which articles can pass one at a time, a slide member disposed in a lower portion of the receptacle below said inclined surface for sliding movement toward and away from said rear wall, spring means operably engaging said slide member to bias the slide member away from said rear wall, a delivery channel in the upper surface of the slide member said delivery channel being movable with the slide member between a receiving position vertically aligned with the discharge opening and a removal position forwardly of the front wall, alignment slots in said inclined surface, alignment fingers protruding upwardly from the slide member adapted to reciprocate through the alignment slots to align articles in the receptacle with the discharge opening, a bottom plate, guide slots through the slide member, and fastener means operably connecting the bottom plate to the receptacle and passing through said guide slots so that the sliding movement of the slide member is guided to prevent misalignment of the slide member within the receptacle.

4. The dispensing apparatus of claim 3 further including gussets anchored to the rear wall and the underside of the inclined surface to support the inclined surface, and threaded holes in the gussets for receiving said fastener means.

5. The dispensing apparatus of claim 3 wherein spring sockets are provided in a rear portion of the slide member to receive said spring means in a manner such that the rearwardmost end of the spring means will engage the rear wall of the receptacle and the forwardmost end of the spring means will engage a wall of the spring socket so that the spring means are positively retained in a postion to continuously bias the slide member away from the rear wall.

6. The dispensing apparatus of claim 3 wherein said slide member is in engagement with the rear wall of the receptacle when the delivery channel is in its receiving position.

* * * * *